United States Patent [19]

Russell

[11] Patent Number: 4,792,087

[45] Date of Patent: Dec. 20, 1988

[54] REMOVABLE COVER FOR BULK CONTAINER

[75] Inventor: Raymond L. Russell, Cedar Falls, Iowa

[73] Assignee: Container Corporation of America, Clayton, Mo.

[21] Appl. No.: 147,545

[22] Filed: Jan. 25, 1988

[51] Int. Cl.[4] ..... B65D 43/02

[52] U.S. Cl. ..... 229/125.15; 220/293

[58] Field of Search ..... 229/125.01, 125.15, 229/125.17; 220/293

[56] References Cited

U.S. PATENT DOCUMENTS 1,871,907 8/1932 Olt ..... 229/125.15

2,241,793 5/1941 Steven ..... 220/293

FOREIGN PATENT DOCUMENTS 854159 10/1952 Fed. Rep. of Germany ..... 220/293

*Primary Examiner*—Donald F. Norton

*Attorney, Agent, or Firm*—Richard W. Carpenter

[57] ABSTRACT

A removable, molded plastic cover for closing a fill opening in a container wall, which cover includes a center panel having a peripheral rim and a plurality of lock tabs extending radially outward therefrom and spaced from each other to define grooves for receiving portions of the container wall adjacent the fill opening to close the opening.

13 Claims, 1 Drawing Sheet

REMOVABLE COVER FOR BULK CONTAINER

BACKGROUND OF THE INVENTION

1. Field of the Invention

This invention relates to closure arrangements for bulk shipping containers, and more particularly to a removable cover adapted for interlocking engagement with the top wall of a bulk container at a fill opening thereof.

2. Description of Background Art

A background search conducted in the United States Patent and Trademark Office and directed to the subject matter of this application disclosed the following U.S. Pat. Nos.: 3,537,956, 3,888,383, 3,964,635, 4,006,837, 4,202,462, 4,428,496, 4,497,419, 4,521,233, and 4,602,654.

None of the patents uncovered in the search dicloses a closure arrangement that includes a removable cover having a center panel with a peripheral rim and a plurality of lock tabs extending radially outwardly therefrom and spaced from each other to form grooves for receiving portions of the top wall of a container adjacent an opening in the wall, so the cover can be locked in a closed position by rotating it relative to the container top wall.

SUMMARY OF THE INVENTION

It is an object of the present invention to provide a removable cover arrangement for a bulk container having a filling and emptying opening in the top wall thereof.

A more specific object of the invention is the provision, in an arrangement of the type described, of a removable cover which can be placed over the opening in a bulk container and rotated a slight distance to lock the cover in a closed position.

Another specific object of the invention is the provision, in an arrangement of the type described, of a removable, molded plastic cover having a center panel with a peripheral rim and a plurality of lock tabs extending radially outwardly therefrom and spaced from each other to define grooves for receiving portions of a container top wall adjacent a filling opening therein.

These and other objects of the invention will be apparent from the following description and drawings.

Figure 1:
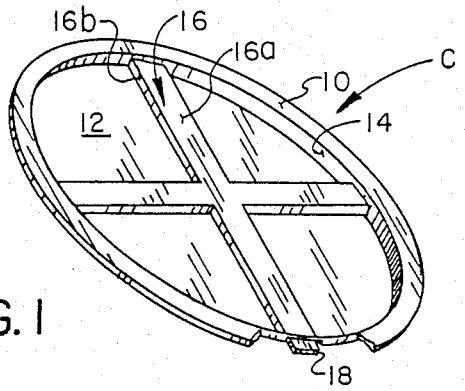
FIGS. 1 and 2 are isometric views as seen from the top and bottom, respectively, of a bulk container cover embodying features of the present invention.

It will be understood that, for purposes of of clarity, certain elements may have been intentionally omitted from certain views where they are believed to be illustrated to better advantage in other views.

DESCRIPTION OF THE PREFERRED EMBODIMENT

Referring now to the drawings for a better understanding of the invention, it will be seen that a cover embodying features of the invention, and indicated generally at C, is adapted for use in closing a fill opening O in the top wall W of a paperboard container, such as a bulk bin or box B.

Figure 6:
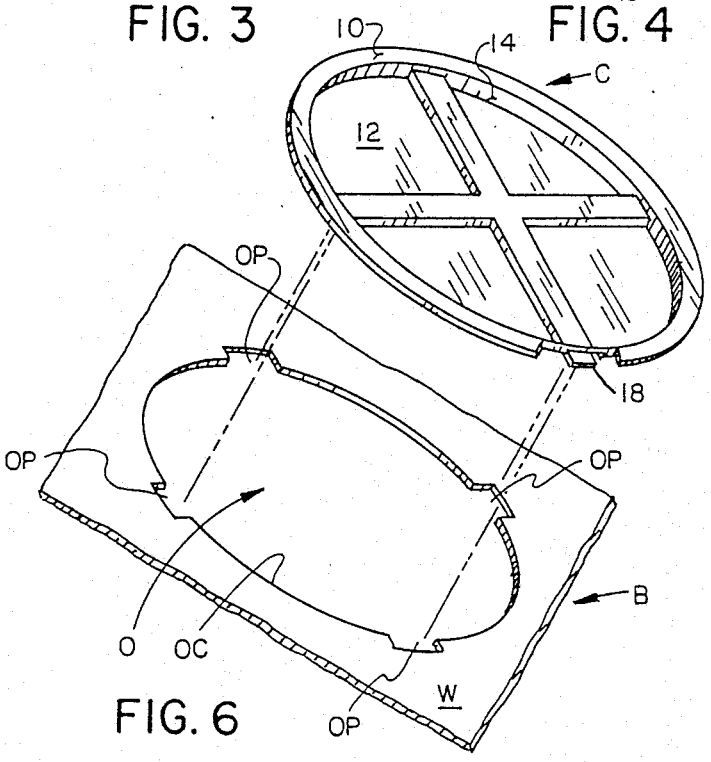
FIG. 6 is an exploded, fragmentary, isometric view of a cover and portions of a container, showing the relationship of the cover to the opening in the container.

As best seen in FIG. 6, the opening O includes a circular center portion OC and a plurality of circumferentially spaced projections OP which extend radially outward from the outer periphery of the center portion. The purpose of the projections is to receive lock tabs of the cover in a manner described later in the specification.

Turning now to FIGS. 1 through 5, it will be seen that the novel cover C, which may be formed from molded plastic material, includes a relatively thin flat annular rim 10 and a relatively thin, flat, circular center panel 12, which is spaced downwardly a slight distance from the rim 10 and which is joined to the rim by a relatively short cylindrical flange 14.

To provide additional support for and strengthen the center panel, so that it can be formed from a relatively thin material, the center panel may be reinforced by a plurality of ribs or struts 16, each each of which includes a top wall **16*a* and a pair of side walls 16*b* that join the top wall to the center panel 12 and to the cylindrical flange 14**.

Figure 2:
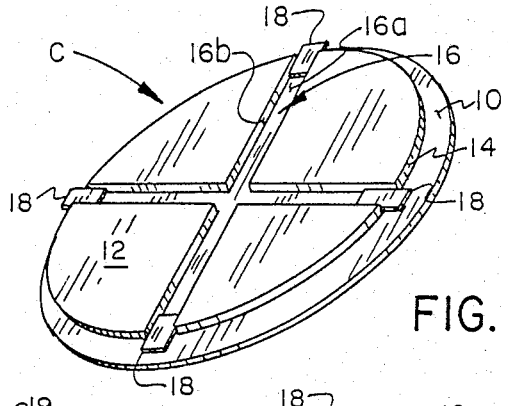
Figure 3:
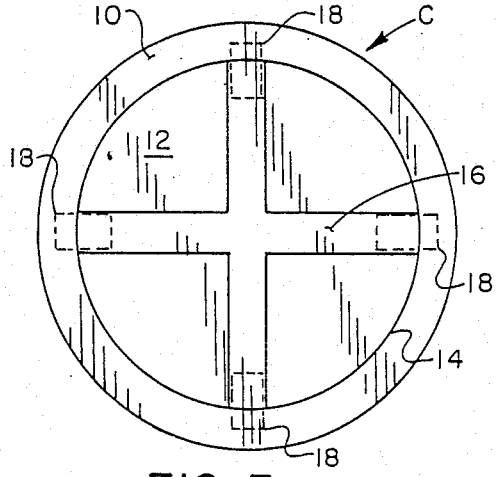
FIG. 3 is a top plan view of the structure illustrated in FIG. 1.

As best seen in FIG. 2, on the bottom side of cover C there are provided a plurality of circumferentially spaced lock tabs 18 which extend radially outward from the center panel 12 a distance slightly less than the width of the rim.

Lock tabs 18 are preferably relatively thin and flat and may be formed in various ways, such as by bonding them to the undersides of the rib top walls **16*a***.

Figure 4:
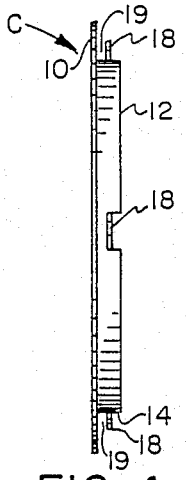
FIG. 4 is a side elevational view of the structure illustrated in FIG. 1.
Figure 5:
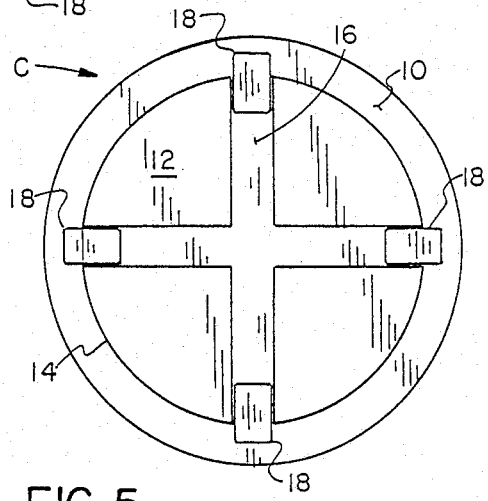
FIG. 5 is a bottom plan view of the structure illustrated in FIG. 1.
Figure 9:
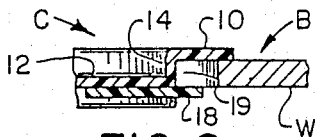
FIGS. 9 and 10 are fragmentary, transverse, vertical sectional views taken on lines 9—9 and 10—10 of FIGS. 7 and 8, respectively.

As best seen in FIGS. 4, 9, and and 10, the lock tabs 18 are spaced downwardly from the rim 10 to provide recesses or grooves 19 therebetween. The lock tabs 18 are slightly smaller than the projections OP, so that when the cover center panel is placed within the container top wall opening center portion OC, the lock tabs will fit into the projections OP.

Figure 7:
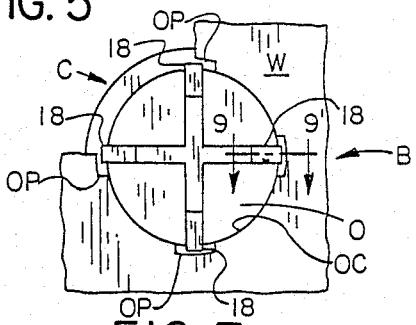
FIG. 7 is a fragmentary bottom plan view of the cover positioned in an opening of a container wall, with the cover shown in an unlocked position.
Figure 8:
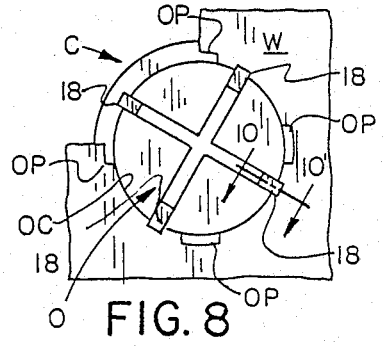
FIG. 8 is a view similar to FIG. 7, but with the container cover shown in a locked position.
Figure 10:
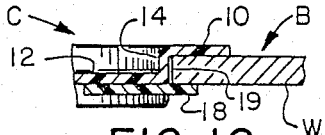

To lock the cover in position on the container top wall, the cover is rotated from the unlocked position, illustrated in FIGS. 7 and 9, to the locked position, illustrated in FIGS. 8 and 10. When the cover C is in the locked position, the portions of the container top wall that are adjacent the opening projections OP are snugly received in the grooves 19 between the lock tabs 18 and the rim 10 to hold the cover in position.

In order to remove the cover from the container, the process is reversed with the cover being rotated in the opposite direction and lifted out of the container top wall opening.

Thus, it will be appreciated that the invention provides a unique means for filling a bulk container with the top wall in place and for emptying the container without having to remove or destroy the top wall of the container.

What is claimed is:

1. A removable, molded plastic cover for closing a container wall opening that includes a circular center portion and a plurality of circumferentially spaced projections extending radially outward therefrom, said cover comprising:

(a) a generally flat annular rim;

(b) an integral, circular, center panel spaced downwardly a slight distance from said rim and having its outer edge joined to an inner edge of said rim by a relatively short, cylindrical flange;

(c) a plurality of radially extending ribs joined to said center panel and said cylindrical flange to reinforce said center panel;

(d) a plurality of relatively flat lock tabs projecting radially outward from said center panel under said rim;

(e) said lock tabs being of the same general shape as, but slightly smaller than, said wall opening projections to permit insertion of the former into the latter;

(f) said lock tabs being spaced from said rim to define therebetween grooves adapted to receive portions of said container wall, so that when said cover is placed in said opening and rotated, said cover will be locked in snug engagement with said container wall.

2. A cover according to claim 1, wherein said ribs are hollow.

3. A cover according to claim 1 wherein said ribs are located between horizontal planes defined by upper and lower edges of said cylindrical flange.

4. A cover according to claim 1, wherein the outer ends of said lock tabs are disposed radially inwardly from the outer edge of said rim.

5. A cover according to claim 1, wherein said lock tabs are aligned with and extend from said ribs.

6. A removable, molded plastic, cover for closing a container wall opening that has a circular center portion with a plurality of circumferentially spaced projections extending radially outward therefrom, said cover comprising:

(a) a generally flat annular rim;

(b) an integral, circular, center panel having its outer edge joined to an inner edge of said rim;

(c) a plurality of lock tabs projecting radially outward from said center panel under said rim;

(d) said lock tabs being of the same general shape as, but slightly smaller than, said wall opening projections to permit the insertion of the former into the latter;

(e) said lock tabs being spaced from said rim to define therebetween grooves adapted to receive portions of said container wall, so that when said cover is placed in said container wall opening and rotated said cover will be locked in snug engagement with said container wall.

7. A cover according to claim 6, wherein said center panel is spaced downwardly from said rim and is joined thereto by a relatively short, cylindrical flange.

8. A cover according to claim 6, wherein said center panel includes a plurality of integral, radially extending, reinforcing ribs.

9. A cover according to claim 8, wherein said ribs are disposed above upper surface of said central panel and below an upper surface of said rim.

10. A cover according to claim 8, wherein said ribs are hollow.

11. A cover according to claim 8, wherein said ribs are located between horizontal planes defined by upper and lower edges of said cylindrical flange.

12. A cover according to claim 8, wherein the outer ends of said lock tabs are disposed radially inwardly from the outer edge of said rim.

13. A cover according to claim 8, wherein said lock tabs are aligned with and extend from said ribs.

* * * * *